US006851673B2

(12) United States Patent
Tsai

(10) Patent No.: US 6,851,673 B2
(45) Date of Patent: Feb. 8, 2005

(54) OPERATION BAR FOR A GAME TABLE

(75) Inventor: Lore Tsai, Taichung (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 0 days.

(21) Appl. No.: 10/609,663

(22) Filed: Jul. 1, 2003

(65) Prior Publication Data

US 2005/0001375 A1 Jan. 6, 2005

(51) Int. Cl.[7] ..... A63F 7/06

(52) U.S. Cl. ..... 273/108.1; 273/108.52; 273/129 R; 273/108.54

(58) Field of Search ..... 273/108–108.56, 273/119 R, 119 A, 126 R, 126 A, 129 R–129 W

(56) References Cited

U.S. PATENT DOCUMENTS 3,428,316 A * 2/1969 Cane ..... 273/108.51
3,475,028 A * 10/1969 Lanzafame et al. .... 273/108.51
3,554,547 A * 1/1971 Vedeen et al. ..... 273/108.51
3,801,100 A * 4/1974 Lebrun ..... 273/108.56
3,817,523 A * 6/1974 Nolte ..... 273/108.53
4,065,128 A * 12/1977 Gomori ..... 273/108.52
4,146,224 A * 3/1979 Deutsch ..... 273/108.52
4,304,405 A * 12/1981 Laine ..... 273/108.51
4,691,921 A * 9/1987 Iseki ..... 273/108.51
4,976,434 A * 12/1990 Wikner ..... 273/108.31
5,074,557 A * 12/1991 Broussard, Sr. ..... 273/108.41
6,464,220 B1 * 10/2002 Tsai ..... 273/108.52
6,623,005 B1 * 9/2003 Tsai ..... 273/108.1
6,648,329 B2 * 11/2003 Tsai ..... 273/108.51

* cited by examiner

*Primary Examiner*—Sebastiano Passaniti
(74) *Attorney, Agent, or Firm*—Troxell Law Office PLLC

(57) ABSTRACT

An operation bar for a game table, including: an outer bar; an inner bar movably nested in the outer bar, the inner and outer bars being synchronously rotatable, one end of the inner bar protruding from the outer bar; a rack fixed at inner end of the inner bar and fitted in the outer bar; a gear set including a predetermined number of gears and a roller, the gear set being mounted in the outer bar, whereby when pushing or pulling the inner bar, the rack drives the gear set to make the roller rotate; a doll unit fitted around the outer bar and slidable along the outer bar; and a cable body, the body of the cable body being wound around the roller of the gear set, two ends of the cable body being respectively wound around two ends of the outer bar and extended out of the outer bar to connect with two sides of the doll unit.

14 Claims, 7 Drawing Sheets

OPERATION BAR FOR A GAME TABLE

BACKGROUND OF THE INVENTION

The present invention is related to a game apparatus, and more particularly to an operation bar for a game table such as a soccer table and a hockey table. Several dolls are mounted on the operation bar. The dolls are drivable by the operation bar.

A soccer table or a hockey table is equipped with several operation bars. One or more dolls are mounted on each operation bar. By means of pushing and pulling and turning the operation bar, the dolls are driven to shift a ball body on the table.

The conventional operation bar is simply a bar body so that the displacement of the operation bar is exactly the displacement of the dolls. Such structure has some shortcomings. For example, it is impossible to quickly move the dolls.

Furthermore, with the soccer table exemplified, two ends of the operation bar are passed through two sides of the table body. When pushing/pulling the operation bar to drive the dolls, the operating end and rear end (the other end) of the operation bar will protrude from the table body. The room where the game table is placed must have reserve space for the protruding ends of the operation bar. Therefore, the space is wasted. Moreover, when the rear end of the operation bar protrudes from the table body, the other player on the other side of the table body may get hurt.

In order to solve the above problem, this applicant filed U.S. patent application Ser. No. 10/128,299, entitled "rotary bar of game table". The rotary bar includes an inner and an outer bars and one or more gear set disposed between the inner and outer bars. A predetermined number of dolls are fitted around the outer bar. When pushing/pulling the inner bar, via the gear set, the dolls are driven to move along the outer bar.

The gear set is such designed as to magnify the rotational speed, whereby the displacement of the dolls is greater than the displacement of the inner bar. Therefore, the moving speed of the dolls is increased. Also, in operation, the rear end of the rotary bar will not protrude from the table body so that the reserved space is reduced. In addition, the other player is protected from being collided and hurt.

However, the above Patent Application still has some shortcomings. A certain number of dolls are mounted on the rotary bar of the table body, for example, one to five. In the case that five dolls are mounted on the rotary bar, a short displacement of the rotary bar will make the displacement range of the dolls covers the entire table body. In the case of one doll, it will be necessary for the rotary bar to move by a considerably long distance to make the displacement range of the doll cover the entire table body. With respect to the rotary bar with short displacement, only one gear set is necessary. However, With respect to the rotary bar with long displacement, multiple gear sets must be disposed in the rotary bar at equal intervals for one by one transmitting power to the doll and moving the same.

In the case of multiple gear sets, the power can be hardly truly transmitted to the doll. Moreover, it is hard to install multiple gear sets and the cost is higher.

SUMMARY OF THE INVENTION

It is therefore a primary object of the present invention to provide an operation bar for a game table, in which only one gear set is necessary to be installed in the operation bar no matter how many dolls are mounted on the operation bar.

It is a further object of the present invention to provide the above operation bar of the game table, which is able to truly and smoothly transmit power to the dolls for driving the same.

The present invention can be best understood through the following description and accompanying drawings wherein:

DETAILED DESCRIPTION OF THE PREFERRED EMBODIMENTS

Figure 1:
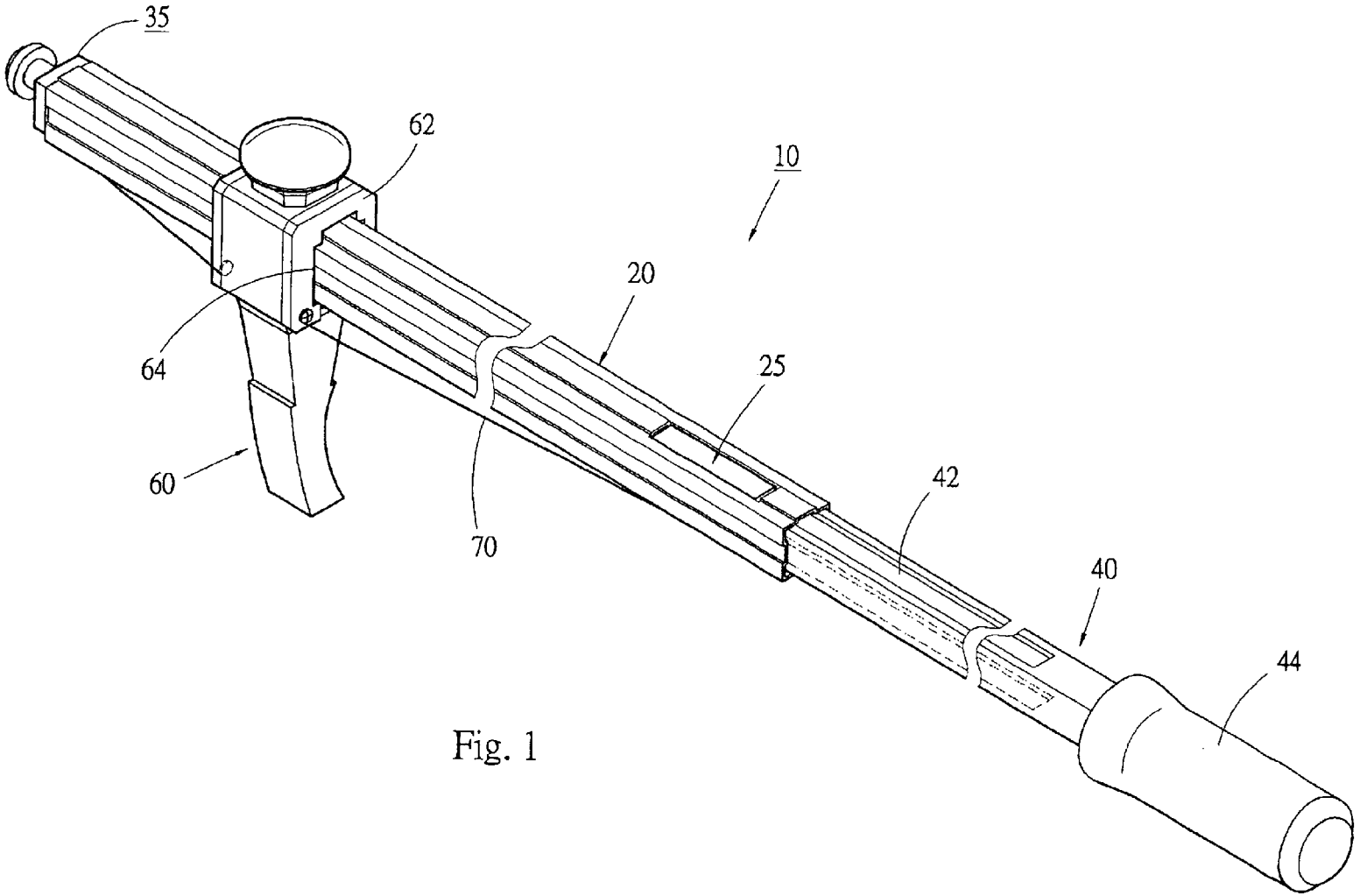
FIG. 1 is a perspective assembled view of a first embodiment of the present invention.
Figure 2:
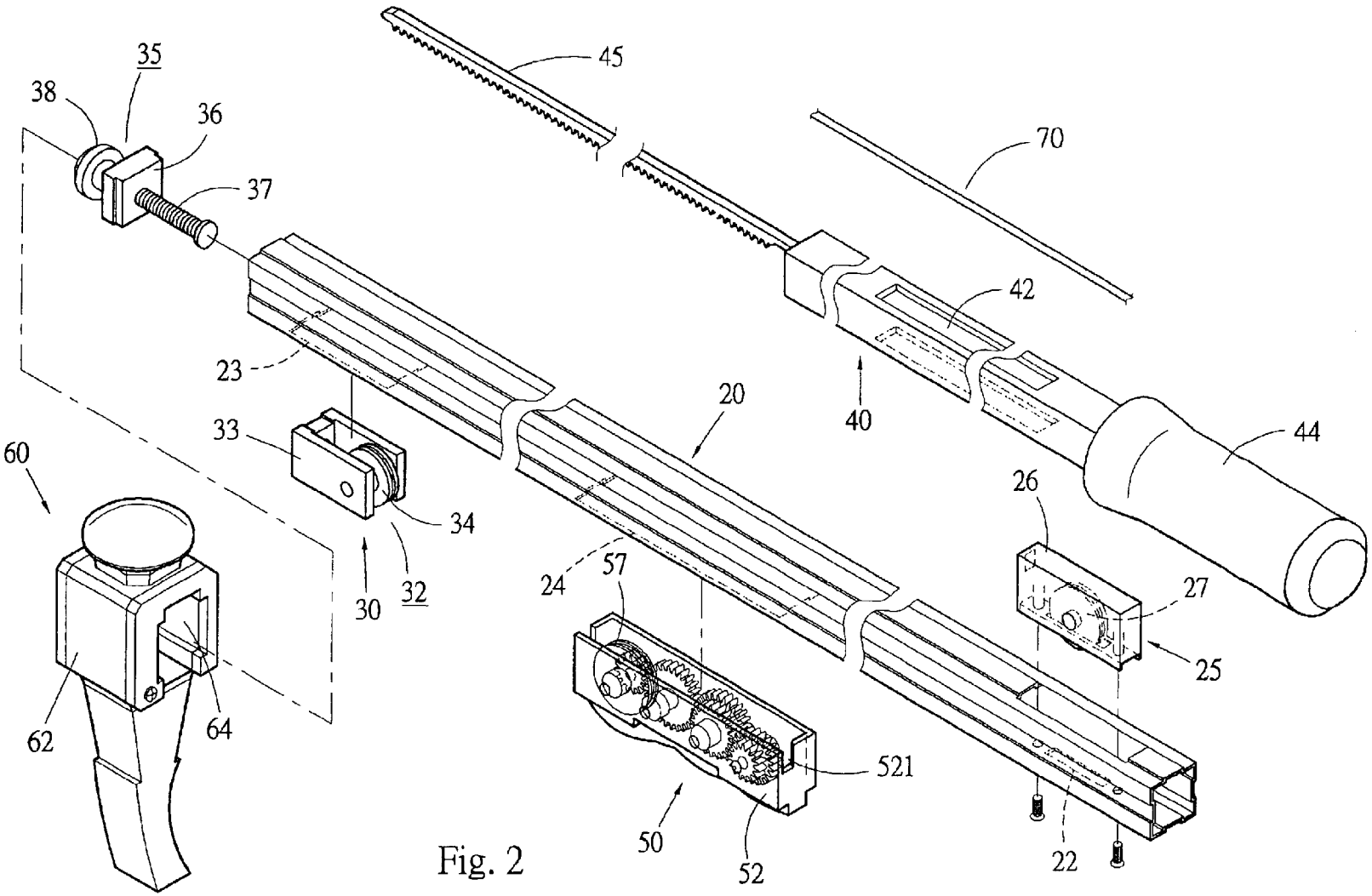
FIG. 2 is a perspective exploded view of the first embodiment of the present invention.

Please refer to FIGS. 1 and 2. According to a first embodiment, the operation bar 10 for a game table of the present invention includes an outer bar 20, an inner bar 40, a rack 45, a gear set 50, a doll unit 60 and a cable body 70.

The inner bar 40 is slidably nested in the outer bar 20. The length of the inner bar is shorter than the length of the outer bar. The inner and outer bars can be synchronously rotated. In order to achieve this object, the inner and outer bars are hollow bar bodies with polygonal cross-section.

Two ends of the bottom face of the outer bar 20 are respectively formed with two slots 22, 23. The bottom face of the outer bar 20 is further formed with a third slot 24 between the two slots 22, 23.

Figure 4:
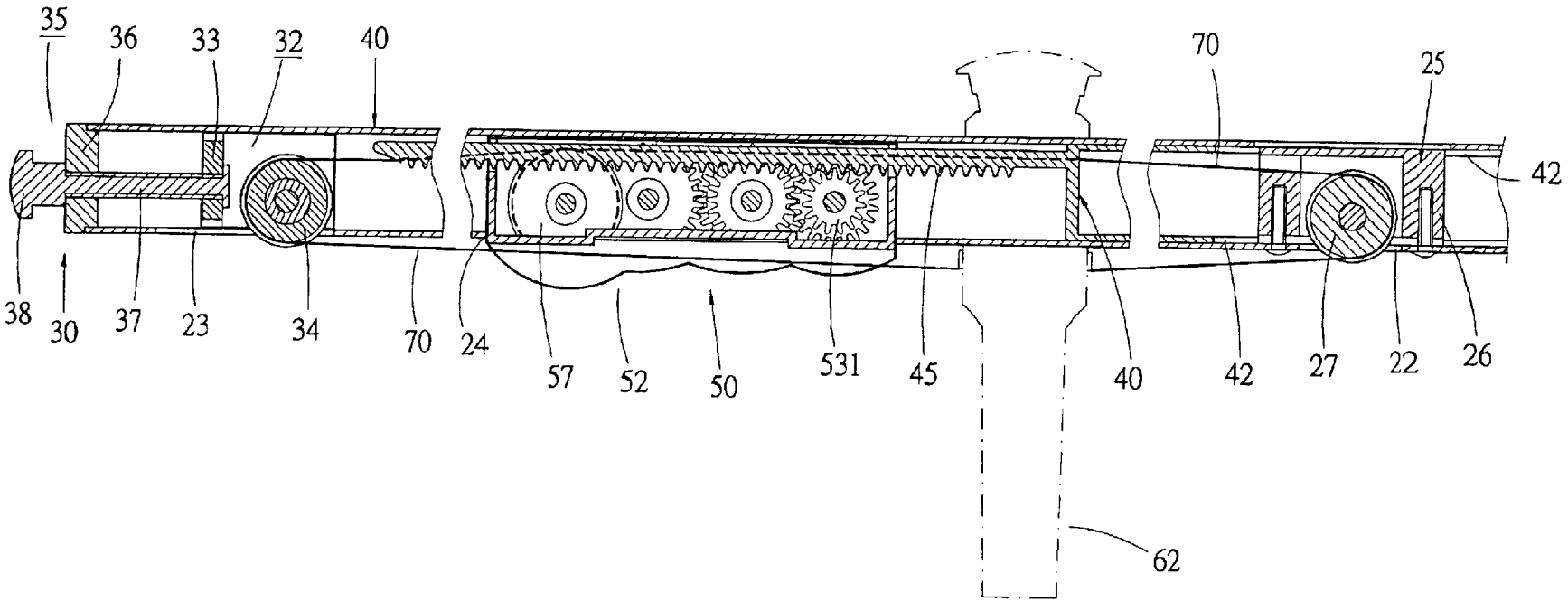
FIG. 4 is an enlarged view of a part of FIG. 3.

Two pulley units, in this embodiment, the pulley units are a fixed pulley unit 25 and an adjustable pulley unit 30. The fixed pulley unit has a pulley seat 26 in which a first pulley 27 is pivotally disposed. The fixed pulley unit 25 is fixed in the outer bar 20 by two screws and positioned at front end of the outer bar in alignment with the slot 22 as shown in FIG. 4. The adjustable pulley unit 30 has a pulley assembly 32 and an adjustment assembly 35. The pulley assembly 32 includes a pulley seat 33 and a second pulley 34 mounted in the pulley seat 33. The adjustment assembly 35 includes an end cap 36 and a bolt 37 rotatably disposed on the end cap. The bolt 37 is located in the end cap 36 by a fixing member such as a C-shaped retainer, whereby the bolt 37 can only rotated on the end cap without moving back and forth. The pulley assembly 32 is movably installed in the outer bar 20 and positioned at rear end thereof in alignment with the slot 23 as shown in FIG. 4. The end cap 36 is plugged in the rear end of the outer bar. The inner end of the bolt 37 is screwed with the pulley seat 33. A rotary switch 38 is disposed at outer end of the bolt and manually rotatable for adjusting the position of the pulley assembly.

The top and bottom faces of the inner bar 40 are formed with axial slots 42 having a certain length. When the inner bar is nested in the outer bar 20, the fixed pulley unit 25 is right positioned within the slots 42. When the inner bar is moved, two ends of the slots will abut against the fixed pulley unit 25 to serve as a front and a rear dead end of the travel of the inner bar. A handle 44 is disposed at outer end of the inner bar for a user to hold.

The rack 45 is fixed at inner end of the inner bar and axially outward extends from the inner bar by a certain length. The rack 45 is fitted in the outer bar along with the inner bar.

Figure 5:
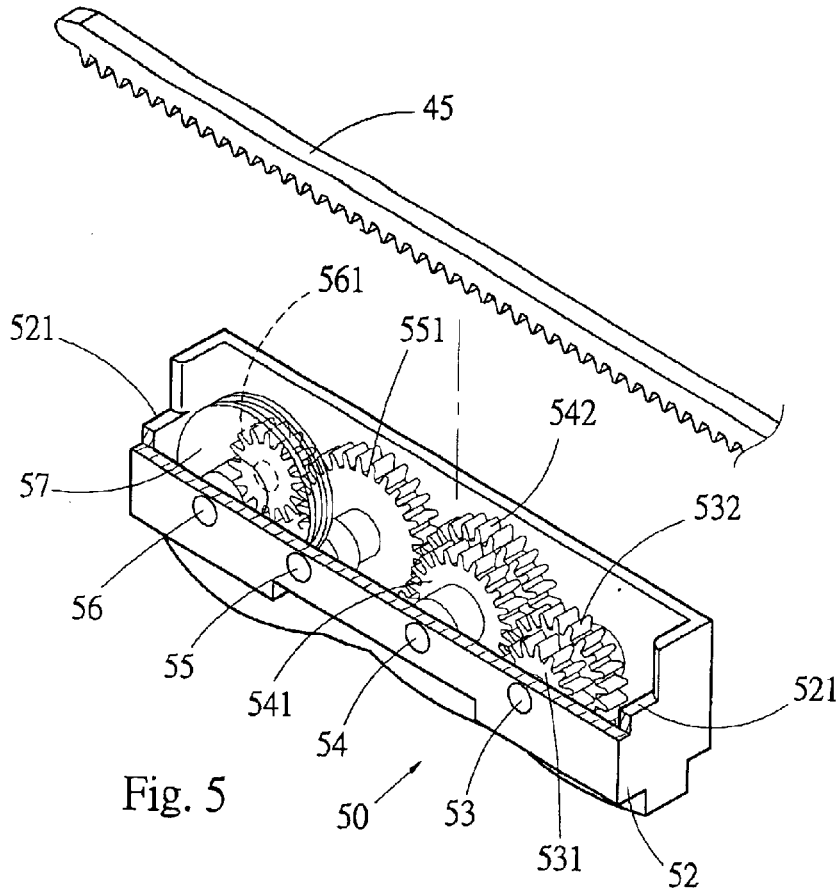
FIG. 5 is a perspective view of the gear set of the present invention.
Figure 6:
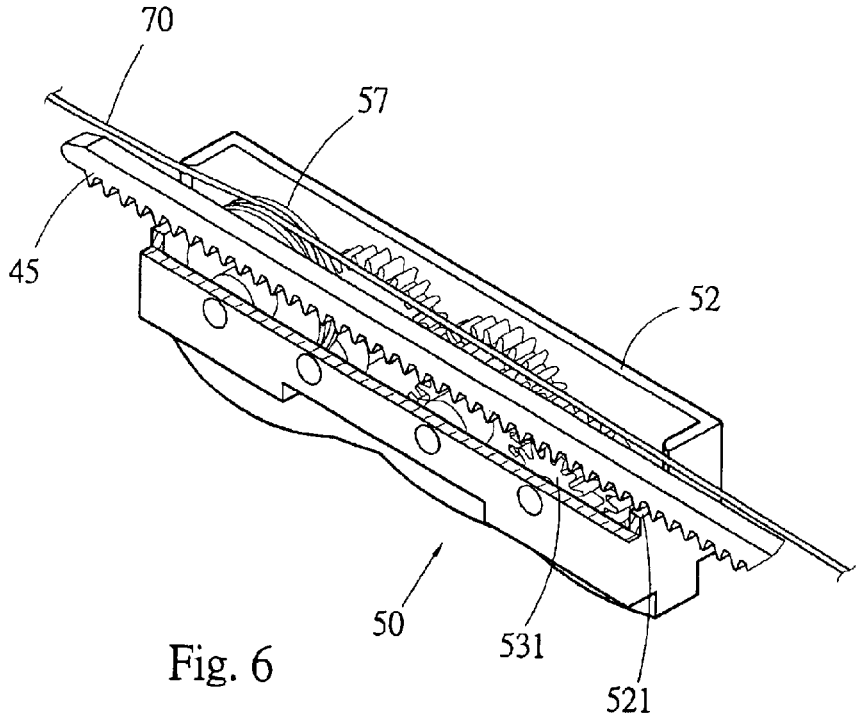
FIG. 6 shows that the rack is engaged with the gear set of the present invention.

The gear set 50 has a casing 52 and several serially engaged gears mounted in the casing 52. Please refer to FIG. 5. In this embodiment, four parallel shafts are disposed in the casing 52. A small gear 531 and a large gear 532 are synchronously rotatably disposed on the first shaft 53. A small gear 541 and a large gear 542 are synchronously rotatably disposed on the second shaft 54. The large gear meshes with the small gear 541. A gear 551 is disposed on the third shaft 55 and engaged with the large gear 542. A small gear 561 and a roller 57 are synchronously rotatably disposed on the fourth shaft 56. The small gear 561 meshes with the gear 551. The small gear 531 disposed on the first shaft is a power input gear, while the small gear 561 disposed on the fourth shaft is a power output gear. According to the transmission state, the rotational speed of the output gear 561 is greater than the rotational speed of the input gear 531. In this embodiment, the ratio of rotational speed is 5:3. The gear set 50 is fixedly mounted in the outer bar 20 from the slot 24. Referring to FIGS. 4 and 6, the rack 45 extends through the notches 521 of front and rear ends of the casing 52 into the gear set 50 to engage with the power input gear 531.

The doll unit 60 in this embodiment has a doll 62 formed with a through hole 64 through which the outer bar 20 is fitted. The do 62 can be slid along the outer bar.

The cable body 70 in this embodiment is preferably a steel cable. Referring to FIG. 6, the body of the cable is first wound around the roller 57 of the gear set 50 by one circle. Then two ends of the cable respectively extend out from the notches 521 of two ends of the casing 52 of the gear set. Then the two ends of the cable are respectively wound on the pulleys 27, 34 of the two pulley units 25, 30. Then, the two ends respectively extend out of the outer bar 20 from the two slots 22, 23 and fixed on two sides of the doll 62 as shown in FIG. 4. Accordingly, the cable body 70 is wound between the gear set 50, the pulley units 25, 30 and the doll 62 to form a loop.

Figure 3:
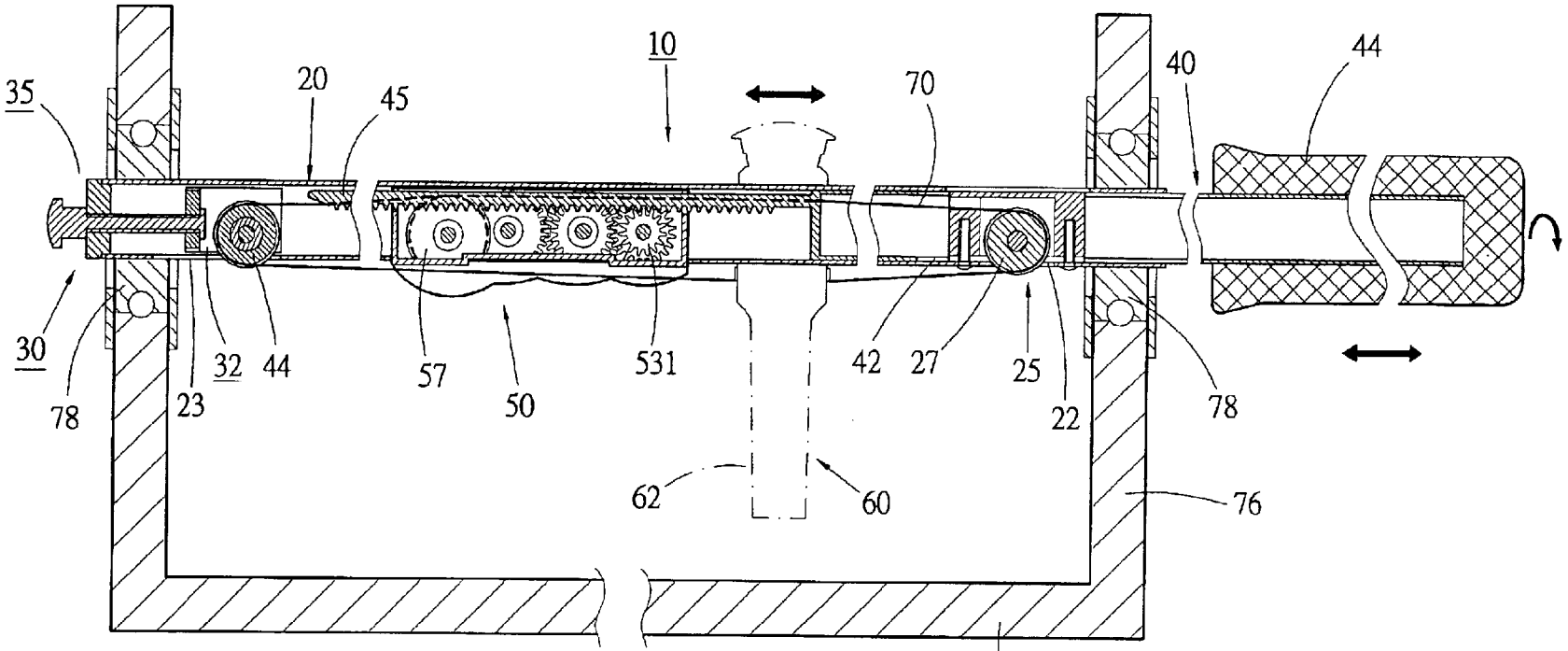
FIG. 3 is a longitudinal sectional view of the first embodiment of the present invention, showing that the operation bar is mounted on the game table.

FIG. 1 is a perspective view showing the assembled operation bar of the present invention. Referring to FIG. 3, two ends of the outer bar 20 are fixed on two long sides 76 of a game table 75 such as a soccer table. The inner bar 40 is exposed to outer side of the table for a user to operate. Two bearings 78 are respectively fitted around two ends of the outer bar, whereby the operation bar can be rotated on the table body. The bearings 78 pertain to prior art and will not be further described hereinafter.

In use, as shown in FIG. 3, when pushing or pulling the inner bar 40, the rack 45 will drive the power input gear 531 which sequentially transmits power to the power output gear 561 to make the roller 57 rotate. The roller 57 will drive the cable body 70 to revolve for driving the doll 62 to move along the outer bar 20. After the doll is moved to the position where the ball body is placed on the table, the player can turn the inner bar to synchronously drive the outer bar 20 and the doll 62 to rotate. Accordingly, the doll can drive the ball body to play the game.

When the user rotates the bolt 37 of the adjustable pulley unit 30, the pulley assembly 32 is moved within the outer bar so as to adjust the tension of the cable body 70.

Figure 7:
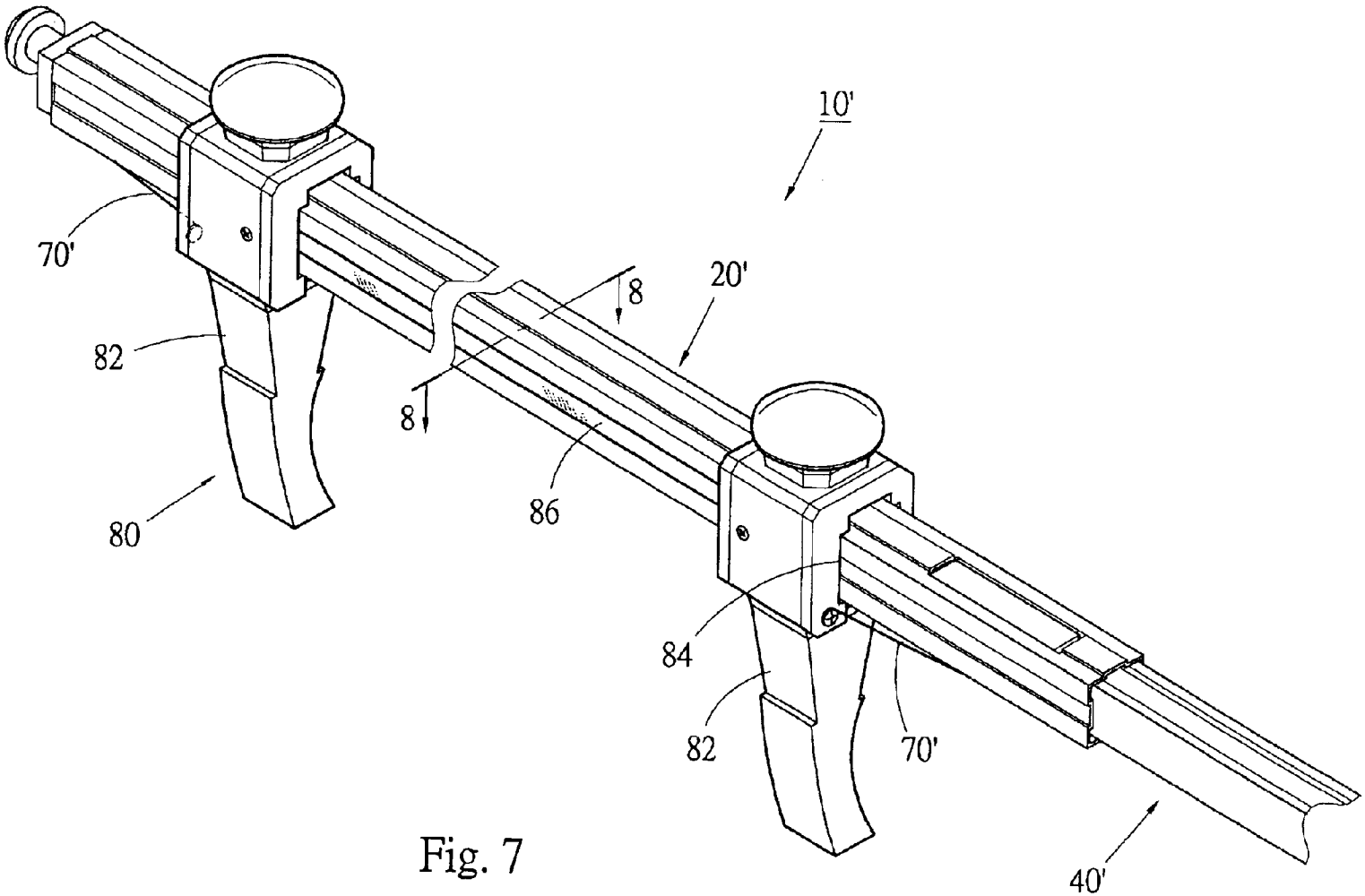
FIG. 7 is a perspective assembled view of a second embodiment of the present invention.
Figure 8:
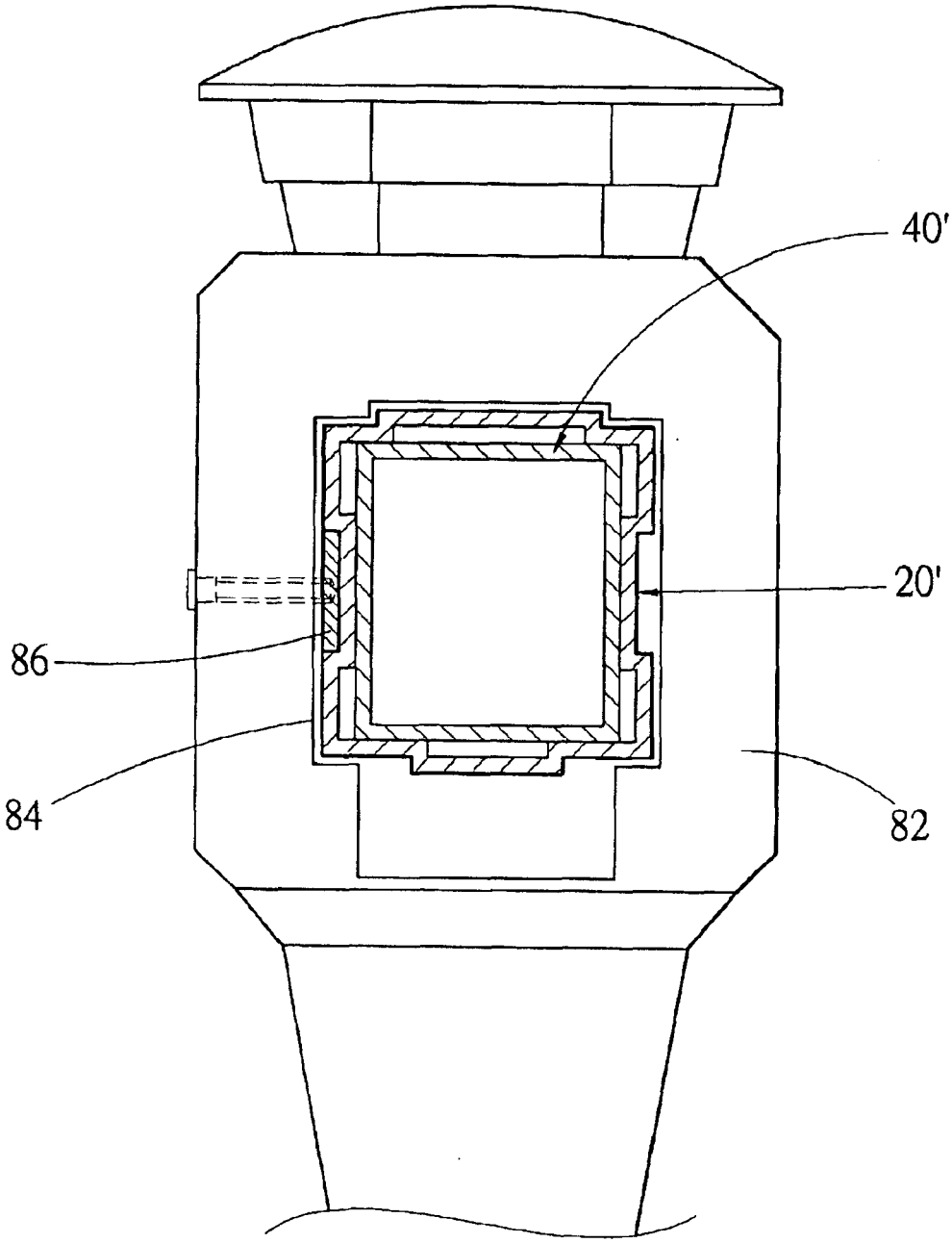
FIG. 8 is a sectional view taken along line 8—8 of FIG. 7.

FIGS. 7 and 8 show another embodiment of the operation bar of the present invention, Most structures of the operation bar 10' are identical to those of the first embodiment and are denoted by the same reference numerals.

The second embodiment is different from the first one in the doll unit. Two to five dolls are mounted on the operation bar. In this embodiment, the doll unit 80 has two dolls 82 formed with through holes 84 for the outer bar 20' to pass therethrough. A connecting member 86 is connected between two adjacent dolls, whereby multiple dolls can be synchronously moved. Two ends of the cable body 70' are connected to two sides of the doll unit 80, that is, connected to the two outermost dolls. Accordingly, when the cable body 70' is driven to revolve, multiple dolls are synchronously moved.

Therefore, no matter how many dolls are mounted on the operation bar, it is necessary to mount only one gear set and one cable body on the operation bar for driving the dolls.

The single gear set can achieve truer transmission. In addition, it is easier to mount the gear set and the cost is lowered.

It should be noted that the pulleys disposed at two ends of the outer bar are not inevitable. Only proper members such as small rods are necessary for the cable body to wind thereon. Moreover, in the case that the pulleys are disposed at two ends of the outer bar, both the pulleys can be fixed without adjustment function.

The above embodiments are only used to illustrate the present invention, not intended to limit the scope thereof.

What is claimed is:

1. An operation bar for a game table, comprising:

an outer bar which is a hollow bar body;

an inner bar slidably nested in the outer bar from a front end thereof, the inner and outer bars being synchronously rotatable, one end of the inner bar protruding from the outer bar for a player to hold;

a rack fixed at an inner end of the inner bar and axially outwardly extending from the inner bar by a certain length, the rack being fitted in located in an interior of the outer bar along with the inner bar;

a gear set including a predetermined number of gears and a roller, the gear set being mounted in the outer bar, the gears serving to transmit power for driving the roller to rotate, the rack being engaged with the gear set, whereby when pushing or pulling the inner bar, the rack drives the gear set to make the roller rotate;

a doll unit having at least one doll, each of the at least one doll fitted around the outer bar and slidable along the outer bar; and a cable body, the body of the cable body being wound around the roller of the gear set, a first end of the cable body being wound around a first end of the outer bar, extended out of the outer bar, and connected to a first end of the doll unit, a second end of the cable body being wound around a second end of the outer bar, extended out of the outer bar, and connected to a second end of the doll unit.

2. The operation bar as claimed in claim 1, wherein the doll unit has at least two dolls, a connecting member connected between each of two adjacent dolls of the at least two dolls, each of the first and the second ends of the cable body being connected to one of two outermost dolls of the at least two dolls.

3. The operation bar as claimed in claim 1, wherein the doll unit has one doll and each of the first and the second ends of the cable body are connected to one of two opposing sides of the doll.

4. The operation bar as claimed in claim 1, wherein two pulleys are respectively disposed at two ends of the outer bar and the cable body is wound over the two pulleys.

5. The operation bar as claimed in claim 1, further comprising an adjustable pulley unit having a pulley assembly and an adjustment assembly, the pulley assembly being mounted in the outer bar and positioned at a rear end of the outer bar and movable along the outer bar, the adjustment assembly being disposed at the rear end of the outer bar and connected with the pulley assembly, the adjustment assembly being manually operable for driving the pulley assembly to move within the outer bar, one end of the cable body being wound over the pulley assembly.

6. The operation bar as claimed in claim 5, wherein the pulley assembly includes a pulley seat and a pulley mounted in the pulley seat, the pulley seat being movable within the outer bar, the adjustment assembly including an end cap and a bolt rotatably disposed on the end cap, the end cap being plugged in the rear end of the outer bar, an inner end of the bolt being screwed with the pulley seat, an outer end of the bolt being exposed to the outer side of the outer bar.

7. The operating bar as claimed in claim 1, further comprising a fixed pulley unit having a pulley seat and a pulley pivotally disposed in the pulley seat, the fixed pulley unit being fixed in the outer bar and positioned at the front end of the outer bar, one end of the cable body being wound over the pulley.

8. The operation bar as claimed in claim 7, wherein the inner bar is formed with an axial slot, whereby when the inner bar is nested in the outer bar, the fixed pulley unit is positioned within the slot.

9. The operation bar as claimed in claim 1, wherein the gear set includes a power input gear and a power output gear, the power input gear serving to transmit power to the power output gear for driving the same, the roller being synchronously rotatable with the power output gear, the rack being engaged with the power input gear.

10. The operation bar as claimed in claim 9, wherein when the gear set is rotated, the rotational speed of the power output gear is greater than the rotational speed of the power input gear.

11. The operation bar as claimed in claim 1, wherein two ends of the bottom face of the outer bar are respectively formed with two slots and two ends of the cable body respectively extend out of the outer bar from the two slots.

12. The operation bar as claimed in claim 1, wherein the bottom face of the outer bar is formed with a third slot, the gear set including a casing in which the gears and the roller are rotatably disposed, the gear set being mounted in the outer bar from the third slot.

13. The operation bar as claimed in claim 1, wherein two ends of the casing are respectively formed with two notches, the rack extending through the notches into the casing.

14. The operation bar as claimed in claim 1, wherein the inner and outer bars are hollow bar bodies with a polygonal cross-section.

* * * * *